US010295927B2

(12) United States Patent
Tanimoto

(10) Patent No.: US 10,295,927 B2
(45) Date of Patent: May 21, 2019

(54) PRINT HEAD, IMAGE FORMING APPARATUS AND LIGHT EMITTING DEVICE

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Koji Tanimoto, Kannami Tagata Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/263,496

(22) Filed: Sep. 13, 2016

(65) Prior Publication Data

US 2018/0074429 A1 Mar. 15, 2018

(51) Int. Cl.
*G03G 15/04* (2006.01)
*G03G 15/043* (2006.01)

(52) U.S. Cl.
CPC ..... *G03G 15/043* (2013.01); *G03G 15/04054* (2013.01)

(58) Field of Classification Search
CPC ..... G03G 15/043
See application file for complete search history.

(56) References Cited

U.S. PATENT DOCUMENTS

2008/0030566 A1* 2/2008 Nomura ..... B41J 2/45 347/130
2009/0315965 A1* 12/2009 Yamagata ..... B41J 2/45 347/130
2010/0086331 A1* 4/2010 Inoue ..... G03G 15/326 399/220
2012/0056547 A1 3/2012 Mitsuse et al.
2014/0320579 A1* 10/2014 Ohno ..... H01L 33/005 347/141
2016/0126500 A1 5/2016 Uesaka et al.
2017/0351193 A1 12/2017 Ishikawa et al.
2017/0353622 A1 12/2017 Ishikawa et al.

FOREIGN PATENT DOCUMENTS

JP 2007-210277 8/2007
JP 2014-217986 11/2014

OTHER PUBLICATIONS

Extended European Search Report for European Patent Application No. 17190475.8 dated Feb. 23, 2018.

* cited by examiner

*Primary Examiner* — David M. Gray
*Assistant Examiner* — Michael A Harrison
(74) *Attorney, Agent, or Firm* — Amin, Turocy & Watson LLP

(57) ABSTRACT

In accordance with an embodiment, a print head comprises a transparent substrate, a drive circuit, a first light emitting element (emitter), a second light emitting element (emitter) and a lens. The drive circuit supplies a current. The first light emitting element (emitter) which is an element on the transparent substrate outputs first light with a predetermined wavelength through supply of the current. The second light emitting element (emitter) which is an element on the transparent substrate outputs second light with the predetermined wavelength through the supply of the current. The lens converges a third light generated by overlapping the first light and the second light.

24 Claims, 5 Drawing Sheets

PRINT HEAD, IMAGE FORMING APPARATUS AND LIGHT EMITTING DEVICE

FIELD

Embodiments described herein relate generally to a print head, an image forming apparatus, a light emitting device, and associated methods.

BACKGROUND

There is known a printer, a copier and a multi-functional peripheral (MFP) using an electrophotographic process. As an exposure module (exposure unit) of each of these devices, there are known two methods called as a laser optical system (LSU: laser scan unit) and a print head (solid head). In the laser optical system, a photoconductive drum is exposed through a laser beam that carries out scanning with a polygon mirror. In the print head, a photoconductive drum is exposed through light output by a plurality of light emitting elements (emitters) such as an LED (Light Emitting Diode).

The laser optical system undesirably consumes much energy at the time of forming an image and the sound during operation is very noisy as it is necessary to rotate the polygon mirror at a high speed. As a mechanism for scanning the laser light is necessary, there is a tendency to be a large unit shape.

On the other hand, the print head can be constituted by a small-size exposure unit. The function of the small-size exposure unit is realized by using a lens, referred to as a rod lens array, for forming a non inverted image with the light emitted from the light emitting element (emitter). As there is no movable section, the small-size exposure unit is a silent exposure unit.

A print head using an organic Light Emitting Diode other than the LED is also developed. In a case of using the organic Light Emitting Diode, it is possible to collectively form the organic Light Emitting Diode on a substrate with a mask and the light emitting element (emitter) can be arranged with higher accuracy than a case of arranging the LED chips. Thus, if the organic Light Emitting Diode is used as the light emitting element (emitter), there is an advantage that an image can be formed with high accuracy.

For example, there is known an example in which a plurality of the light emitting elements (emitters) composed of the organic Light Emitting Diodes is formed on a glass substrate. If a current only for ensuring a light emission amount necessary for image formation with the foregoing structure flows, degradation is aggravated, and total light-emitting time and the light emission amount are reduced. If the light emission amount is reduced, appropriate image density cannot be obtained.

DETAILED DESCRIPTION

In accordance with an embodiment, a print head comprises a transparent substrate, a drive circuit, a first light emitting element (emitter), a second light emitting element (emitter) and a lens. The drive circuit supplies a current. The first light emitting element (emitter) which is an element on the transparent substrate outputs first light with a predetermined wavelength through supply of the current. The second light emitting element (emitter) which is an element on the transparent substrate outputs second light with the predetermined wavelength through the supply of the current. The lens converges third light generated by overlapping the first light and the second light.

In accordance with another embodiment, a printing method involves supplying a current; outputting a first light with a predetermined wavelength through supply of the current; outputting a second light with the predetermined wavelength through the supply of the current; and converging a third light generated by overlapping the first light and the second light.

Hereinafter, the embodiment is described with reference to the accompanying drawings.

Figure 1:
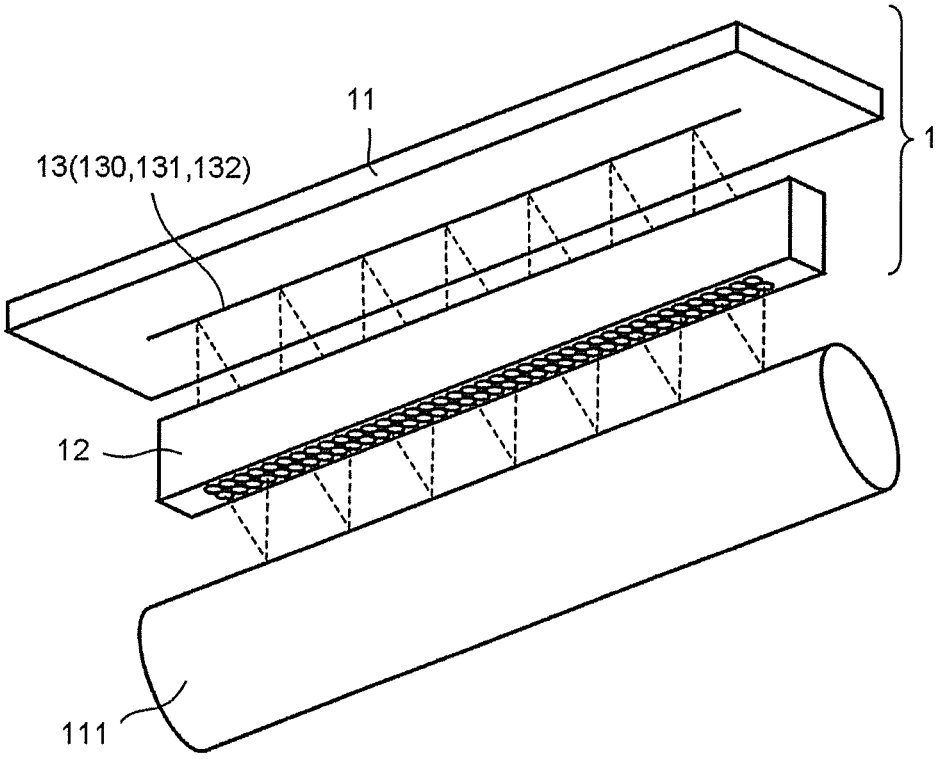
FIG. 1 is a diagram illustrating an example of a positional relation between a photoconductive drum and a print head.

FIG. 1 is a diagram illustrating an example of a positional relation between a photoconductive drum and a print head used in an electrophotographic process. For example, an image forming apparatus such as a printer, a copier or a multi-functional peripheral is equipped with a photoconductive drum 111 shown in FIG. 1, and a print head 1 is arranged opposite to the photoconductive drum 111.

As shown in FIG. 1, the print head 1 is equipped with a transparent substrate 11 and a rod lens array 12. For example, the transparent substrate 11 is a glass substrate. The light from a plurality of light emitting elements forming a light emitting element row 13 on the transparent substrate 11 passes through the rod lens array 12 to be focused on the photoconductive drum 111. The light emitting element row 13 is constituted by a plurality of light emitting element groups 130, and the light emitting element group 130 is constituted by a plurality of the light emitting elements. For example, the light emitting element group 130 is constituted by multiplexed light emitting elements, for example, a first light emitting element 131 and a second light emitting element 132. The multiplexed structure of the light emitting element is described in detail later.

The photoconductive drum 111 is uniformly charged by a charger and the potential thereof decreases through being exposed through light from the light emitting element group 130. In other words, by controlling emission and non-emission of the light emitting element group 130, it is possible to form an electrostatic latent image on the photoconductive drum 111.

Figure 2:
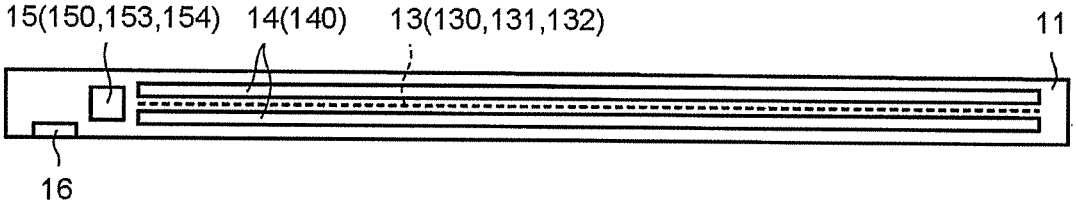
FIG. 2 is a diagram illustrating an example of a transparent substrate constituting the print head.

FIG. 2 is a diagram illustrating an example of the transparent substrate constituting the print head.

As shown in FIG. 2, the light emitting element row 13 is formed at the central part on the transparent substrate 11 along a longitudinal direction of the transparent substrate 11. In the vicinity of the light emitting element row 13, a DRV circuit row 14 is formed which drives each light emitting element (multiplexed first light emitting element 131 and second light emitting element 132) (enables each light emitting element to emit light).

In FIG. 2, the DRV circuit rows 14 is arranged at both sides centering on the light emitting element row 13; however, the DRV circuit row 14 may be arranged at one side.

The transparent substrate 11 is equipped with an IC (Integrated Circuit) 15. The IC 15 is equipped with a D/A (digital to analog) conversion, circuit 150, a selector 153 and an address counter 154. The D/A conversion circuit 150, the selector 153 and the address counter 154 supply a signal for controlling luminous intensity and on/off of each light emitting element to the DRV circuit 140. The transparent substrate 11 is equipped with a connector 16. The connector 16 electrically connects the print head 1 with the printer, the copier or the multi-functional peripheral.

For example, a substrate for sealing each light emitting element and the DRV circuit 140 to prevent them from contacting with open air is mounted in the transparent substrate 11.

Figure 3:
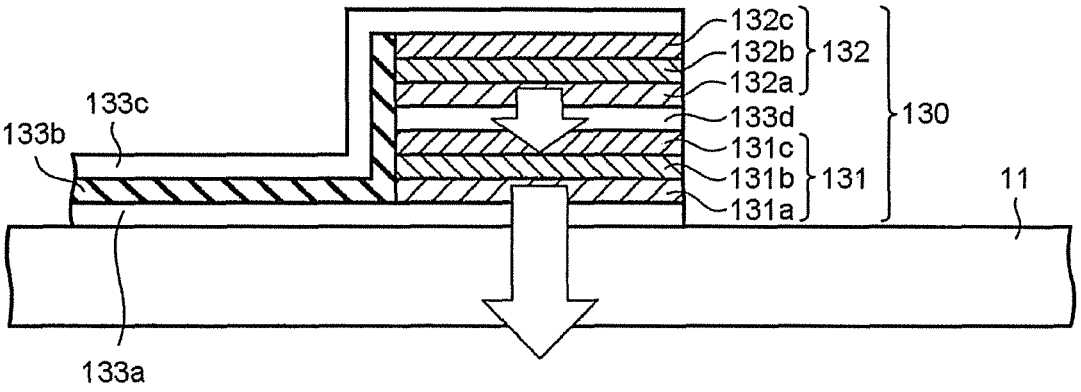
FIG. 3 is a diagram illustrating a first example of one set of light emitting elements (light emitting element group)

FIG. 3 is a diagram illustrating a first example of one set of the light emitting elements (light emitting element group).

The light emitting element group 130 includes the laminated first light emitting element 131 and second light emitting element 132. The first light emitting element 131 and the second light emitting element 132 are connected in series. In FIG. 3, the substrate for sealing is omitted.

A plurality of the light emitting element groups 130 is formed on the transparent substrate 11. For example, one light emitting element group 130 includes the first light emitting element 131 and the second light emitting element 132. The first light emitting element 131 and the second light emitting element 132 contact with an electrode (+) 133*a* and an electrode (−) 133*c* insulated by an insulating layer 133*b* and are sandwiched there between. An electrode 133*d* is sandwiched between the first light emitting element 131 and the second light emitting element 132.

The first light emitting element 131 contacts with the electrode (+) 133*a* on the transparent substrate 11 and the electrode 133*d* and is sandwiched there between. The first light emitting element 131 includes a first hole transport layer 131*a*, a first luminescent layer 131*b* and a first electron transport layer 131*c*. For example, the first luminescent layer 131*b* is a Light Emitting Diode (LED).

The second light emitting element 132 contacts with the electrode 133*d* and the electrode (−) 133*c* and is sandwiched there between. The second light emitting element 132 includes a second hole transport layer 132*a*, a second luminescent layer 132*b* and a second electron transport layer 132*c*. For example, the second luminescent layer 132*b* is the Light Emitting Diode.

A wavelength (predetermined wavelength) of the first light output by the first light emitting element 131 is substantially identical to that of the second light output by the second light emitting element 132 (peak intensity of the first light and that of the second light are substantially identical). The wavelength contained in a range of an error of the wavelength caused by an individual difference between the first light emitting element 131 and the second light emitting element 132 is substantially identical. In other words, the first light and the second light are substantially identical color (for example, red), and the print head 1 overlaps the same color to ensure the amount of the light necessary for image formation. Further, the first light emitting element 131 and the second light emitting element 132 is formed by the same material so as to output the light with the substantially identical wavelength.

The side of the second luminescent layer 132*b* opposite to the transparent substrate 11 reflects the second light emitted by the second luminescent layer 132*b*. For example, the second electron transport layer 132*c* has a structure (reflection characteristic) for reflecting the second light from the second luminescent layer 132*b*. Alternatively, the electrode (−) 133*c* has a structure (reflection characteristic) for reflecting the second light from the second luminescent layer 132*b*.

The second hole transport layer 132*a*, the electrode 133*d*, the first electron transport layer 131*c* and the first hole transport layer 131*a* have permeability for the first light emitted from the first luminescent layer 131*b* and the second light emitted from the second luminescent layer 132*b*. With such a configuration, the first light and the second light are output towards the transparent substrate 11. In other words, the second light is output towards the first light, and the third light generated by overlapping the first light and the second light is output towards the transparent substrate 11.

In this way, the first light emitting element 131 and the second light emitting element 132 emit the first light and the second light with the substantially identical wavelength. The second electron transport layer 132*c* or the electrode (−) 133*c* at a side opposite to the transparent substrate 11 has a structure to reflect the first light and the second light emitted by the first light emitting element 131 and the second light emitting element 132. In this way, the first light and the second light can be overlapped in one direction to be output as the third light. Compared with a case of outputting the light from one light emitting element, through using the third light, more amount of the light can be obtained.

The first light emitting element 131 and the second light emitting element 132 shown in FIG. 3 are connected in series. With such a structure, the current flows in a forward direction towards the electrode (+) 133*a* and the electrode (−) 133*c*, and thus, the first light emitting element 131 and the second light emitting element 132 can emit the light. The substantially identical current flows to the first light emitting element 131 and the second light emitting element 132.

Figure 4:
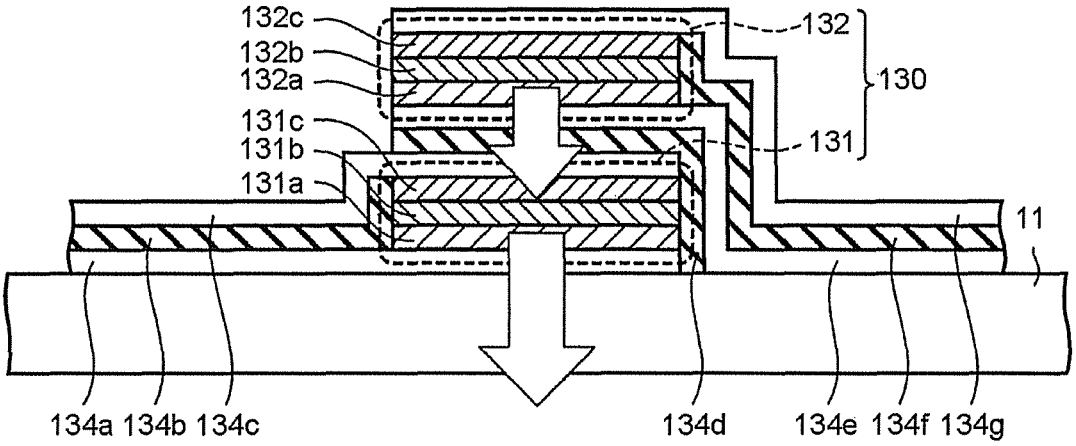
FIG. 4 is a diagram illustrating a second example of one set of light emitting elements (light emitting element group)

FIG. 4 is a diagram illustrating a second example of one set of light emitting elements (light emitting element group). The light emitting element group 130 includes the laminated first light emitting element 131 and second light emitting element 132. The first light emitting element 131 and the second light emitting element 132 are connected in parallel. In other words, the electrodes are respectively extracted from the first light emitting element 131 and the second light emitting element 132 independently. The substrate for sealing is omitted in FIG. 4.

As shown in FIG. 4, the light emitting element group 130 is formed on the transparent substrate 11. For example, the light emitting element group 130 includes the first light emitting element 131 and the second light emitting element 132. The first light emitting element 131 and the second light emitting element 132 are laminated via an insulating layer 134*d*. The first light emitting element 131 contacts with an electrode (+) 134*a* and an electrode (−) 134*c* insulated by the insulating layer 134*b* and is sandwiched there between. The second light emitting element 132 contacts with an electrode (+) 134*e* and an electrode (−) 134*g* insulated by an insulating layer 134*f* and is sandwiched there between.

By arranging the insulating layer 134*d* between the first the light emitting element 131 and the second light emitting element 132, the independent first light emitting element 131 and second light emitting element 132 are laminated.

As the first light from the first light emitting element 131 and the second light from the second light emitting element 132 are output to the transparent substrate 11 side, the insulating layer 134*d* has transparency for the first and the second light.

The side of the second luminescent layer 132*b* opposite to the transparent substrate 11 reflects the second light emitted by the second luminescent layer 132*b*. For example, the second electron transport layer 132*c* has a structure (reflection characteristic) for reflecting the second light from the second luminescent layer 132*b*. Alternatively, the electrode (−) 134*g* has a structure (reflection characteristic) for reflecting the second light from the second luminescent layer 132*b*.

The second hole transport layer 132*a*, the electrode (+) 134*e*, the insulating layer 134*d*, the electrode (−) 134*c*, the first electron transport layer 131*c* and the first hole transport layer 131*a* have permeability for the first light emitted from the first luminescent layer 131*b* and the second light emitted from the second luminescent layer 132*b*. With such a configuration, the first light and the second light are output towards the transparent substrate 11. In other words, the third light generated by overlapping the first light and the second light is output towards the transparent substrate 11.

In this way, the first light emitting element 131 and the second light emitting element 132 emit the first light and the second light with the substantially identical wavelength. The second electron transport layer 132*c* or the electrode (−) 134*g* at a side opposite to the transparent substrate 11 has a structure for reflecting the first light and the second light emitted by the first light emitting element 131 and the second light emitting element 132. In this way, the first light and the second light can be overlapped in one direction to be output as the third light. Compared with a case of outputting the light from one light emitting element, through using the third light, more amount of the light can be obtained.

The first light emitting element 131 is arranged separated from the second light emitting element 132, and thus, the first light emitting element 131 and the second light emitting element 132 can be independently driven.

Figure 5:
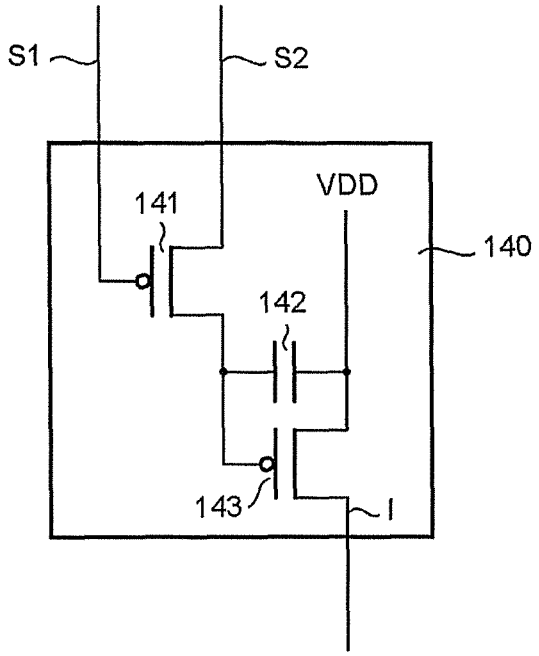
FIG. 5 is a diagram illustrating an example of a DRV circuit for driving the light emitting element.

FIG. 5 is a diagram illustrating an example of the DRV circuit for driving the light emitting element.

A selection signal S1 is supplied to a gate of a thin-film transistor for switching 141 and becomes an "L" level at the time the luminous intensity of the first light emitting element 131 and the second light emitting element 132 connected with the DRV circuit 140 changes. If the selection signal S1 is the "L" level, a voltage of a condenser 142 changes according to a voltage of a light emission level signal S2 supplied to a gate of a thin-film transistor for driving 143.

If the selection signal S1 becomes an "H" level, the voltage of the condenser 142 is maintained. Even if the voltage of the light emission level signal S2 changes, the voltage of the condenser 142 does not change.

A drive current I corresponding to the voltage maintained by the condenser 142 flows to the first light emitting element 131 and the second light emitting element 132 connected with the DRV circuit 140.

Through the selection signal S1, a predetermined light emitting element group 130 is selected from a plurality of the light emitting element groups 130 contained in the light emitting element row 13, and through the light emission level signal S2, the luminous intensity thereof is determined and the luminous intensity can be maintained.

Next, an example in which the first light emitting element 131 and the second light emitting element 132 are connected with one DRV circuit 140 is described.

Figure 6:
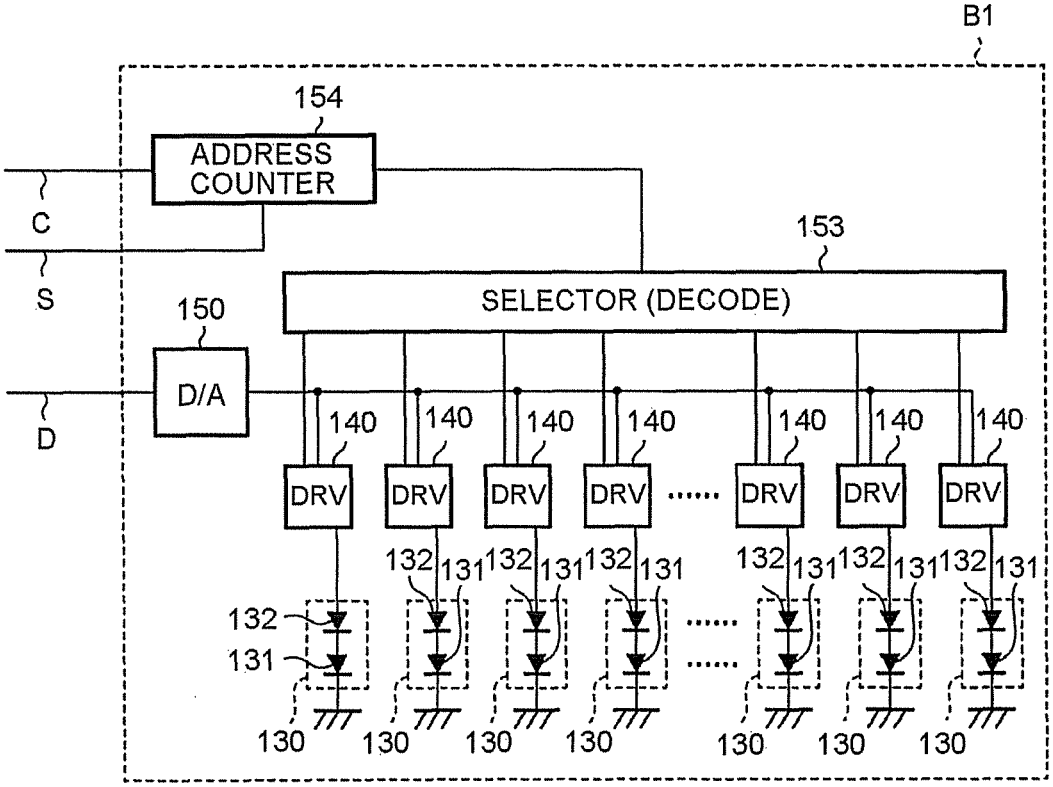
FIG. 6 is a diagram illustrating a first example of a print head circuit block containing a first and a second light emitting elements connected in series.

FIG. 6 is a diagram illustrating a first example of a print head circuit block containing the first and the second light emitting elements connected in series. As shown in FIG. 6, the first light emitting element 131 and the second light emitting element 132 connected in series are connected with one DRV circuit 140. Such a circuit can be constituted to enable the wavelength (wavelength band) of the first light from the first light emitting element 131 and the wavelength (wavelength band) of the second light from the second light emitting element 132 to be substantially identical.

The output of the D/A conversion circuit 150 is connected with the light emission level signal S2 of the DRV circuit 140 described above. The input of the D/A conversion circuit 150 is image data D input to the print head.

The output of the selector 153 is connected with the selection signal S1 of the DRV circuit 140. The input of the selector 153 is the output of the address counter 154. The DRV circuit 140 is selected according to the output value of the address counter 154.

The address counter 154 counts a clock C input to the print head 1. The address counter 154 resets the count with a horizontal synchronization signal S input to the print head 1.

Through inputting the horizontal synchronization signal S to the print head 1 and inputting the image data D in synchronization with the clock C, the light emitting element group 130 can emit the light with the luminous intensity corresponding to the image data in order.

Figure 7:
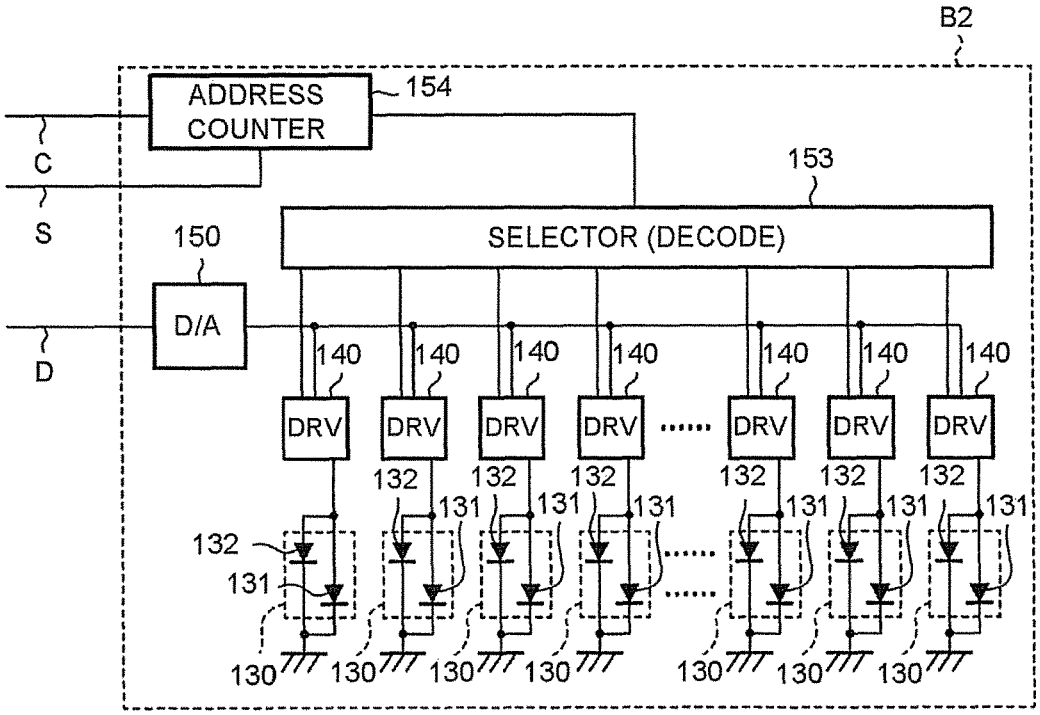
FIG. 7 is a diagram illustrating an example of a head circuit block B2 which contains the first light emitting element and the second light emitting element connected in parallel and associates one light emitting element group including the first light emitting element and the second light emitting element with one DRV circuit.

FIG. 7 is a diagram illustrating an example of a head circuit block B2 which contains the first light emitting element and the second light emitting element connected in parallel and associates one light emitting element group including the first light emitting element and the second light emitting element with one DRV circuit 140. As shown in FIG. 7, the first light emitting element 131 and the second light emitting element 132 connected in parallel are connected with one DRV circuit 140. Such a circuit can be constituted to enable the wavelength (wavelength band) of the first light from the first light emitting element 131 and the wavelength (wavelength band) of the second light from the second light emitting element 132 to be substantially identical.

The difference between the circuit configuration of the head circuit block B2 shown in FIG. 7 and that of ahead circuit block B1 shown in FIG. 6 is the connection method of the first light emitting element 131 and the second light emitting element 132 with the DRV circuit 140. The operation of the head circuit block B2 is basically identical to that of the head circuit block B1, and thus the description thereof is omitted.

Figure 8:
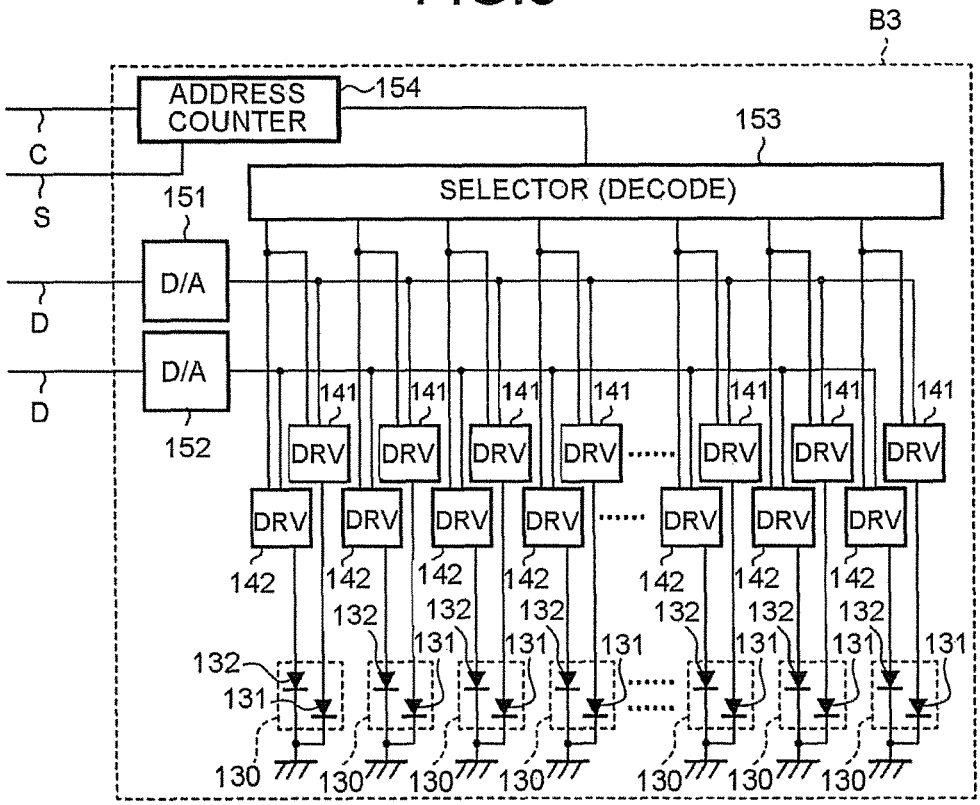
FIG. 8 is a diagram illustrating an example of a head circuit block which contains the first light emitting element and the second light emitting element connected in parallel and associates the first light emitting element and the second light emitting element with DRV circuits respectively.

FIG. 8 is a diagram illustrating an example of a head circuit block which contains the first light emitting element and the second light emitting element connected in parallel and associates the first light emitting element and the second light emitting element with DRV circuits respectively.

The difference between the circuit configuration of a head circuit block B3 shown in FIG. 8 and that of the head circuit block B2 shown in FIG. 7 is that in the head circuit block B3, each first light emitting element 131 is connected with a DRV circuit 141, and each second light emitting element 132 is connected with a DRV circuit 142. A current with a predetermined level is supplied to the first light emitting element 131 from the DRV circuit 141, and similarly, a current with a predetermined level is also supplied to the second light emitting element 132 from the DRV circuit 142. A D/A conversion circuit 151 is connected with one system of the DRV circuit 141, and a D/A conversion circuit 152 is connected with one system of the DRV circuit 142. The operation of the head circuit block B3 is basically identical to that of the head circuit block B1 or B2, and thus, the description thereof is omitted.

Through inputting the image data D in synchronization with the horizontal synchronization signal S and the clock C to two systems of the print head 1 at the same time, the luminous intensity of the first light emitting element 131 and the second light emitting element 132 can be controlled separately.

As stated above, in the print head 1, the first light emitting element 131 and the second light emitting element 132 are overlapped. Through outputting the first light from the first light emitting element 131 and the second light from the second light emitting element 132 overlapped with the first light emitting element 131 in one direction and overlapping the first light and the second light to obtain the third light, the light stronger than that from one light emitting element can be emitted.

In a case of outputting the light with the substantially identical wavelength from the first light emitting element 131 and the second light emitting element 132, the current flowing to each one light emitting element is reduced, and the lifetime of the light emitting element can be lengthened.

Further, in the present embodiment, an example in which two light emitting elements are laminated is described; however, the number of the light emitting elements is not limited to 2, and 3 or more light emitting elements may be laminated.

Further, in the present embodiment, the electrode (+) and the hole transport layer are arranged at the transparent substrate 11 side and the electron transport layer and the electrode (−) are arranged at the opposite side thereof by sandwiching the luminescent layer there between; however, it is not limited to the arrangement. The electrode (−) and the electron transport layer may be arranged at the transparent substrate 11 side, and the hole transport layer and the electrode (+) may be arranged at the opposite side thereof by sandwiching the luminescent layer there between.

Figure 9:
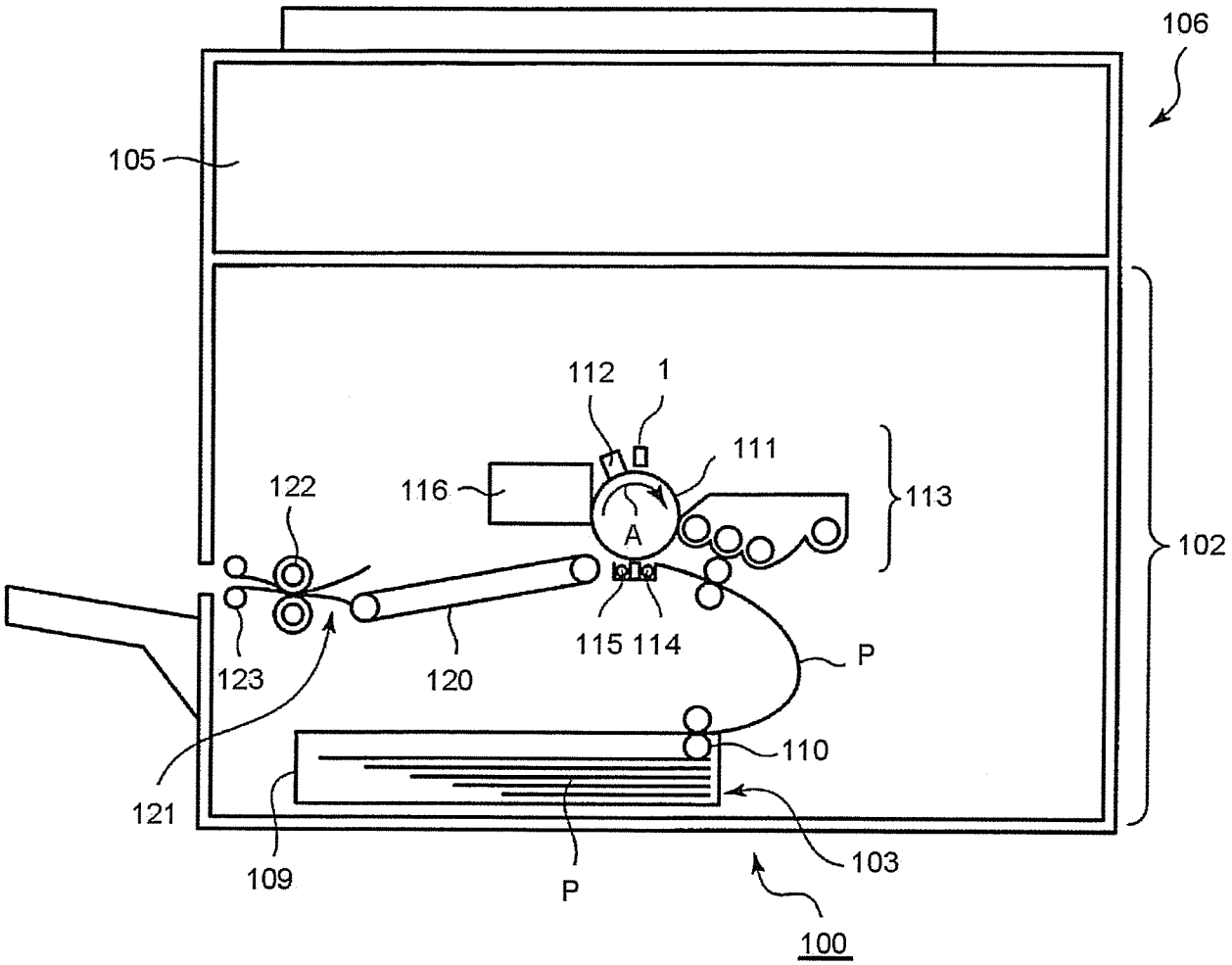
FIG. 9 is a diagram illustrating an example of an image forming apparatus to which the print head of the present embodiment is applied.

FIG. 9 is a diagram illustrating an example of an image forming apparatus to which the print head of the present embodiment is applied. In FIG. 9, an example of a monochrome image forming apparatus is exemplified; however, the print head 1 of the present embodiment is also applied to a color image forming apparatus.

An image forming apparatus 100 is equipped with an image forming section 102 and a scanner section 105. A mechanism of the image forming section 102 is described. The image forming section 102 is equipped with an electrostatic charger 112, a developing device 113, a transfer charger 114, a peeling charger 115 and a cleaner 116 around the photoconductive drum 111. The electrostatic charger 112 uniformly charges the photoconductive drum 111. The developing device 113 develops a latent image created on the basis of the image data from the scanner section 105 on the charged photoconductive drum 111. The transfer charger 114 transfers the image developed on the photoconductive drum 111 onto a sheet P. The cleaner 116 cleans the developing agent remaining on the photoconductive drum 111.

The electrostatic charger 112, the developing device 113, the transfer charger 114, the peeling charger 115 and the cleaner 116 are sequentially arranged in accordance with the rotational direction indicated by an arrow A of the photoconductive drum 111. The image forming section 102 is equipped with the print head 1 arranged to face the photoconductive drum 111.

The image forming section 102 is equipped with a conveyance belt 120 and a sheet discharge conveyance guide 121. The conveyance belt 120 and the sheet discharge conveyance guide 121 sequentially convey the sheet P on which a toner image is transferred to the downstream side of the sheet conveyance direction from the peeling charger 115. Further, the image forming section 102 is equipped with a fixing apparatus 122 and a paper discharge roller 123. The fixing apparatus 122 sequentially fixes the sheet P at the downstream side of the sheet conveyance direction from the sheet discharge conveyance guide 121, and the paper discharge roller 123 discharges the sheet P.

Next, a process operation of the image formation is described.

The electrostatic latent image formed on the photoconductive drum 111 through the light (the third light) from the print head 1 (the first light emitting element 131 and the second light emitting element 132) is developed with the toner (developing agent) supplied from the developing device 113. The photoconductive drum 111 on which the toner image is formed transfers the electrostatic latent image onto the sheet P through the transfer charger 114.

The residual toner on the surface of the photoconductive drum 111 terminating the transfer onto the sheet is removed by the cleaner 116, and then the photoconductive drum 111 returns to an initial state to be a standby state for the next image formation.

By repeating the above process operation, the image forming operation is continuously executed.

In addition, the print head 1 of the present embodiment is not limited to the print head in the electrophotographic process, and it can also be used as an exposure module of a film.

Further, in the present embodiment, a case of applying the transparent substrate 11 and the like to the print head 1 and a case of applying the print head 1 to the image forming apparatus are described; however, the present embodiment is not limited to those. For example, it is also applicable to apply the transparent substrate 11 to various kinds of displays (display devices) to be displays constituted by the transparent substrate 11. Such a display can guarantee the light emission amount and suppress degradation of the light emitting element.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A print head, comprising:

a transparent substrate;

a first light emitter on the transparent substrate configured to output first light with a predetermined wavelength through supply of a current;

a second light emitter arranged at a side of the first light emitter opposite to the transparent substrate while being laminated with the first light emitter and configured to output second light with the predetermined wavelength through the supply of the current; and a lens configured to converge third light generated by overlapping the first light and the second light, wherein the first light is a same color as a color of the second light; and the second light emitter is formed over the first light emitter.

2. The print head according to claim 1, wherein the second light emitter is formed over the first light emitter along a predetermined direction;

the first light emitter outputs the first light in the predetermined direction; and the second light emitter outputs the second light in the predetermined direction.

3. The print head according to claim 1, wherein the first and the second light emitters are independently organic Light Emitting Diodes.

4. The print head according to claim 1, wherein the first and the second light emitters are independently Light Emitting Diodes.

5. The print head according to claim 1, further comprising a drive circuit configured to supply the current.

6. The print head according to claim 1, further comprising an insulator arranged between the first light emitter and the second light emitter.

7. The print head according to claim 1, wherein the second light emitter comprises a reflective layer opposite to the first light emitter.

8. The print head according to claim 5, wherein the first light emitter and the second light emitter are connected with the drive circuit in series.

9. The print head according to claim 5, wherein the first light emitter and the second light emitter are connected with the drive circuit in parallel.

10. A print head, comprising:

a transparent substrate;

a first light emitter on the transparent substrate configured to output first light with a predetermined wavelength through supply of a current from a first drive circuit;

a second light emitter arranged at a side of the first light emitter opposite to the transparent substrate while being laminated with the first light emitter and configured to output second light with the predetermined wavelength through the supply of the current from second drive circuit; and a lens configured to converge third light generated by overlapping the first light and the second light, wherein the first light is a same color as a color of the second light; and the second light emitter is formed over the first light emitter.

11. An image forming apparatus comprising the print head of claim 10.

12. An image forming apparatus, comprising:

a photoconductor;

a charger configured to charge the photoconductor;

a developing device configured to develop a latent image on the photoconductor; and a print head comprising:

a transparent substrate;

a first light emitter on the transparent substrate configured to output first light with a predetermined wavelength through supply of a current;

a second light emitter arranged at a side of the first light emitter opposite to the transparent substrate while being laminated with the first light emitter and configured to output second light with the predetermined wavelength through the supply of the current; and a lens configured to converge third light generated by overlapping the first light and the second light; wherein the print head irradiates the photoconductor with the third light to expose the photoconductor charged by the charger to form the latent image on the photoconductor, wherein the first light is a same color as a color of the second light; and the second light emitter is formed over the first light emitter.

13. The image forming apparatus according to claim 12, wherein the second light emitter is formed over the first light emitter along a predetermined direction;

the first light emitter outputs the first light in the predetermined direction; and the second light emitter outputs the second light in the predetermined direction.

14. The image forming apparatus according to claim 12, wherein the first and the second light emitters are independently organic Light Emitting Diodes.

15. The image forming apparatus according to claim 12, wherein the first and the second light emitters are independently Light Emitting Diodes.

16. The image forming apparatus according to claim 12, further comprising a drive circuit configured to supply the current.

17. The image forming apparatus according to claim 16, wherein the first light emitter and the second light emitter are connected with the drive circuit in series.

18. The image forming apparatus according to claim 16, wherein the first light emitter and the second light emitter are connected with the drive circuit in parallel.

19. A light emitting device, comprising:

a transparent substrate;

a first light emitter on the transparent substrate configured to output first light with a predetermined wavelength through supply of a current; and a second light emitter arranged at a side of the first light emitter opposite to the transparent substrate while being laminated with the first light emitter and configured to output second light with the predetermined wavelength through supply of the current towards the first light, wherein the first light is a same color as a color of the second light; and the second light emitter is formed over the first light emitter.

20. The light emitting device according to claim 19, wherein the first and the second light emitters are independently organic Light Emitting Diodes.

21. The light emitting device according to claim 19, wherein the first and the second light emitters are independently Light Emitting Diodes.

22. The light emitting device according to claim 19, further comprising a drive circuit configured to supply the current.

23. The light emitting device according to claim 22, wherein the first light emitter and the second light emitter are connected with the drive circuit in series.

24. The light emitting device according to claim 22, wherein the first light emitter and the second light emitter are connected with the drive circuit in parallel.

* * * * *